US005687458A

United States Patent [19]

Coker

[11] Patent Number: 5,687,458

[45] Date of Patent: Nov. 18, 1997

[54] CLIP FOR RELEASABLY ATTACHING ARTICLES TOGETHER

[76] Inventor: Jo Ellen Coker, 113 Lakewood Dr., Baytown, Tex. 77520

[21] Appl. No.: 622,562

[22] Filed: Mar. 25, 1996

[51] Int. Cl.[6] ..... A44B 21/00

[52] U.S. Cl. ..... 24/336; 24/341; 24/557; 24/553

[58] Field of Search ..... 24/336, 341, 265 EC, 24/545, 551, 552, 553, 554, 557, 598.5, 598.6, DIG. 29, 228, 230

[56] References Cited

U.S. PATENT DOCUMENTS

| | | | |
|---|---|---|---|
| 867,814 | 10/1907 | Fornander | 24/298 X |
| 1,604,718 | 10/1926 | Pflantzer | 24/300 X |
| 2,195,468 | 4/1940 | Patch | 24/545 |
| 2,653,048 | 9/1953 | Novak | 24/557 X |
| 3,170,206 | 2/1965 | Triplett | 24/298 |
| 4,371,137 | 2/1983 | Anscher . | |
| 4,765,335 | 8/1988 | Schmidt et al. | 24/545 X |

FOREIGN PATENT DOCUMENTS

| | | | |
|---|---|---|---|
| 481602 | 3/1952 | Canada | 24/341 |
| 390558 | 2/1924 | Germany | 24/557 |
| 806473 | 6/1951 | Germany | 24/557 |
| 1319612 | 6/1973 | United Kingdom | 24/336 |

*Primary Examiner*—Peter M. Cuomo
*Assistant Examiner*—Hanh V. Tran
*Attorney, Agent, or Firm*—Kenneth A. Roddy

[57] ABSTRACT

A clip for releasably maintaining articles clipped together has a resilient narrow tether headed at opposite ends with a first resilient clip connected at a rearward end on the headed portion at one end of the tether and a second resilient clip connected at a rearward end on the headed portion at the opposite end in axially opposed relation. The first and second clips each have a pair of longitudinal finger gripping portions extending outwardly from their rearward end in a spaced apart relation and a pair of abutting jaw portions at a forward end thereof. The finger gripping portions are sufficiently resilient such that when pressed together by the fingers of the operator, the jaw portions will open and when released will be urged toward the abutted condition. The jaw portions of the first clip are opened and released to be engaged on or around a first article and the jaw portions of the second clip member are opened and released to be engaged on or around a second article to releasably maintain the first and second articles together. The headed portions of the tether are received through an aperture in the rearward ends of the clips and trapped by a plurality of small thin projections to normally prevent the clips from being pulled off the tether. However, the projections will be sheared off to allow the clip to become disconnected from the tether upon an axial force of sufficient magnitude.

4 Claims, 2 Drawing Sheets

CLIP FOR RELEASABLY ATTACHING ARTICLES TOGETHER

BACKGROUND OF THE INVENTION

1. Field of the Invention

This invention relates generally to garment clips, and more particularly to a clip having opposed clip members for maintaining articles releasably clipped together to prevent them from becoming lost or misplaced and which will separate upon sufficient axial force should one of the articles become caught or snagged to prevent accidents.

2. Brief Description of the Prior Art

There are several patents which disclose garment clips and devices for holding articles together to prevent them from becoming lost or misplaced.

Murray, U.S. Pat. No. 4,045,844 discloses a sock lock device for maintaining a number of pairs of socks together during a washing and drying operation. The device comprises a number of clothespin elements detachably joined together side-by-side in opposed relation with a ball and socket snap-fit connection.

Siegal, U.S. Pat. No. 4,159,792 discloses a ski glove leash for maintaining the glove attached to the wrist or wrist encircling garment, such as a parka sleeve, of the wearer when the glove is temporarily removed. The device is a length of elastic cord with eyleted ends, one end passing through the eyelet at the opposite end to present a loop for encircling the wrist area.

Bartels, U.S. Pat. No. 4,351,067 discloses a pair of work gloves having a strip connected to the cuff of each glove with a pair of mating hook and weave fastener elements secured to opposite ends of the strip. The strip encircles the belt of the wearer and the fastener elements are pressed together so that the glove is releasably attached to the belt. A third hook and weave fastener element is attached to the strip. The fastener element surfaces are dimensioned so that gloves can be disconnected from one another and the hook and weave fasteners that hold each of the strips in a loop configuration will not become disconnected.

The present invention is distinguished over the prior art in general, and these patents in particular by a clip for releasably maintaining articles clipped together which has a resilient narrow tether headed at opposite ends with a first resilient clip connected at a rearward end on the headed portion at one end of the tether and a second resilient clip connected at a rearward end on the headed portion at the opposite end in axially opposed relation. The first and second clips each have a pair of longitudinal finger gripping portions extending outwardly from their rearward end in a spaced apart relation and a pair of abutting jaw portions at a forward end thereof. The finger gripping portions are sufficiently resilient such that when pressed together by the fingers of the operator, the jaw portions will open and when released will be urged toward the abutted condition. The jaw portions of the first clip are opened and released to be engaged on or around a first article and the jaw portions of the second clip member are opened and released to be engaged on or around a second article to releasably maintain the first and second articles together. The headed portions of the tether are received through an aperture in the rearward ends of the clips and trapped by a plurality of small thin projections to normally prevent the clips from being pulled off the tether. However, the projections will be sheared off to allow the clip to become disconnected from the tether upon an axial force of sufficient magnitude.

SUMMARY OF THE INVENTION

It is therefore an object of the present invention to provide a clip for maintaining articles releasably clipped together.

It is another object of this invention to provide a clip which will prevent articles from becoming lost or misplaced.

Another object of this invention is to provide a clip which will maintain articles releasably clipped together and will separate upon sufficient axial force to prevent accidents should one of the articles become caught or snagged.

A further object of this invention is to provide a clip which is simple in construction and economical to manufacture.

Other objects of the invention will become apparent from time to time throughout the specification and claims as hereinafter related.

The above noted objects and other objects of the invention are accomplished by a clip for releasably maintaining articles clipped together which has a resilient narrow tether headed at opposite ends with a first resilient clip connected at a rearward end on the headed portion at one end of the tether and a second resilient clip connected at a rearward end on the headed portion at the opposite end in axially opposed relation. The first and second clips each have a pair of longitudinal finger gripping portions extending outwardly from their rearward end in a spaced apart relation and a pair of abutting jaw portions at a forward end thereof. The finger gripping portions are sufficiently resilient such that when pressed together by the fingers of the operator, the jaw portions will open and when released will be urged toward the abutted condition. The jaw portions of the first clip are opened and released to be engaged on or around a first article and the jaw portions of the second clip member are opened and released to be engaged on or around a second article to releasably maintain the first and second articles together. The headed portions of the tether are received through an aperture in the rearward ends of the clips and trapped by a plurality of small thin projections to normally prevent the clips from being pulled off the tether. However, the projections will be sheared off to allow the clip to become disconnected from the tether upon an axial force of sufficient magnitude.

DESCRIPTION OF THE PREFERRED EMBODIMENT

Figure 1:
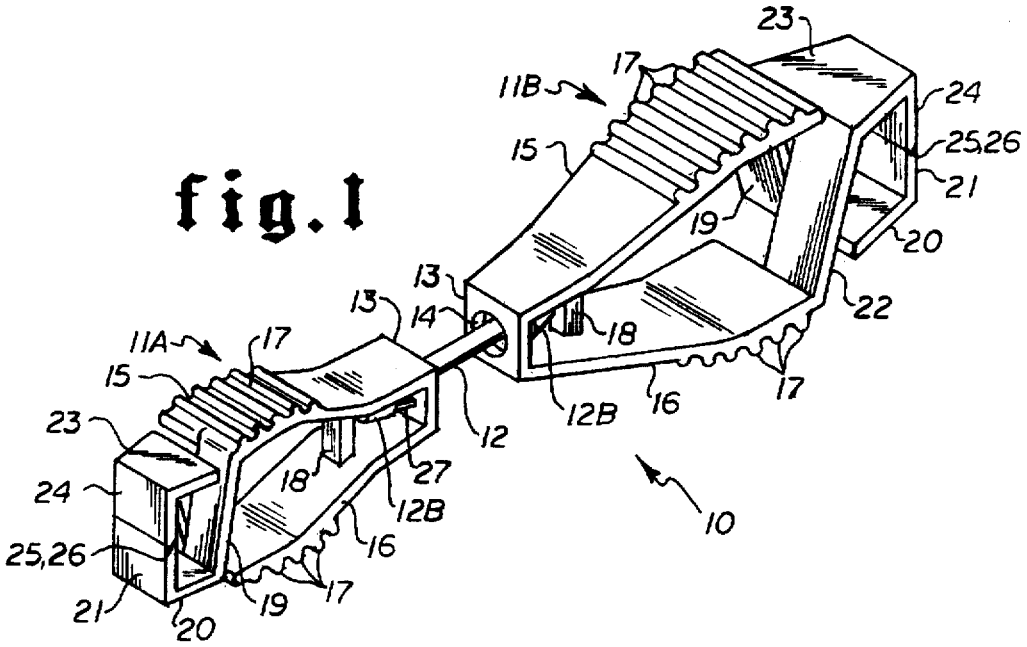
FIG. 1 is a perspective view of the clip device in accordance with the present invention shown from the top, one side, and one end.
Figure 3:
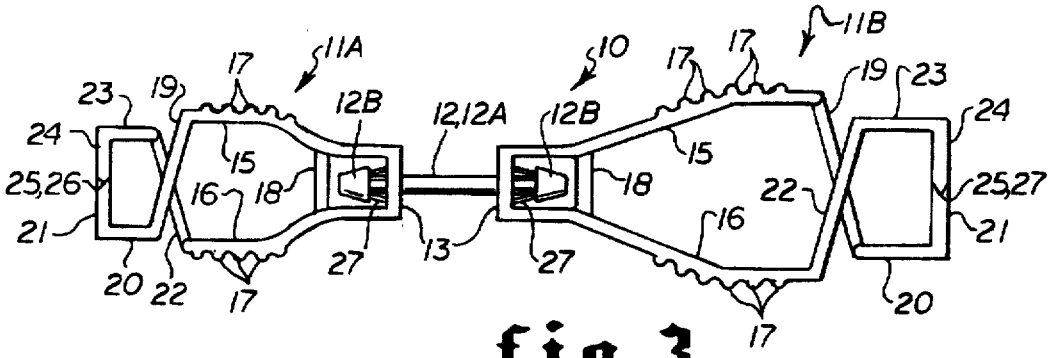
FIG. 3 is a side elevation view of the clip device.
Figure 2:
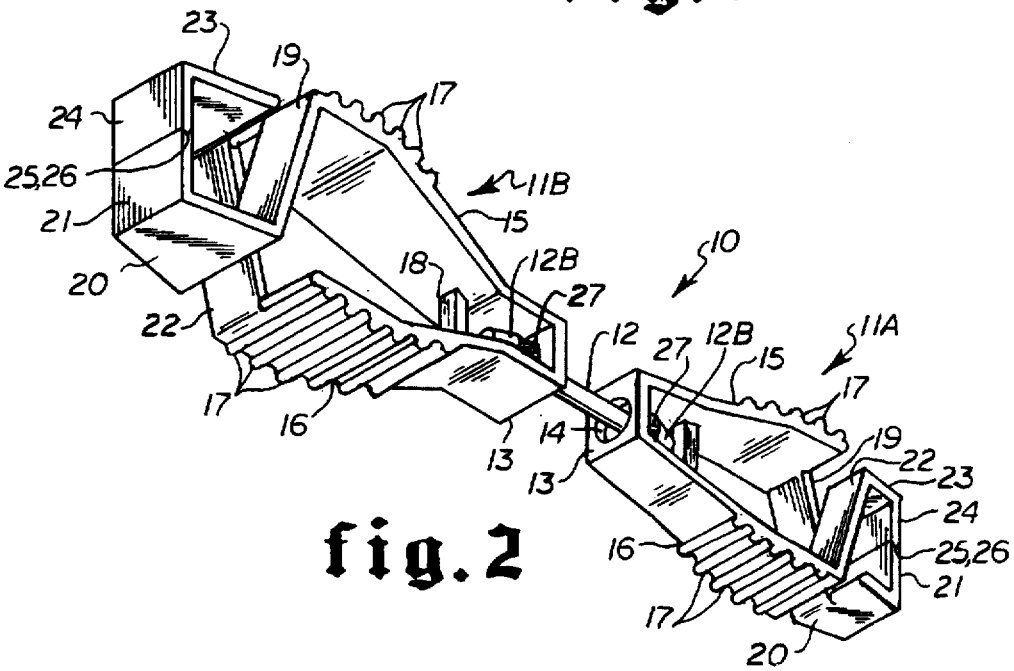
FIG. 2 is a perspective view of the clip device shown from the bottom and side and end opposite that of FIG. 1.

Referring to the drawings by numerals of reference, there is shown in FIGS. 1 through 5, a preferred clip 10. The clip 10 has a pair of clip members 11A and 11B releasably connected together in opposed relation by a flexible rod-like connecting element or tether 12. The preferred clip members 11A, 11B and tether 12 are formed of resilient, dielectric material.

The clip members 11A and 11B are similar in construction, except that one clip 11A may be smaller than the other clip 11B. Each clip 11A, 11B has a generally flat rear wall portion 13 with a circular hole 14 extending therethrough and a pair of rectangular finger grip portions 15 and 16 diverging forwardly from the rear wall in opposed relation in a generally V-shaped configuration as viewed from the side. The outer surface of the rectangular portions 15 and 16 may be provided with a series of transverse ridges 17 to facilitate gripping by the fingers of the user.

A narrow rectangular web portion 18 spaced a short distance forwardly of the rear wall portion 13 extends vertically between the inner surfaces of the rectangular finger grip portions 15 and 16.

The rectangular finger grip portion 15 of each clip has a narrow rectangular portion 29 at one side approximately one-half the width of the rectangular portion 15 which extends angularly downward for a distance, widens to form a lower jaw portion 20 of greater width than the rectangular portion 15, and then extends upwardly to form an upstanding vertical jaw portion 21.

The rectangular finger grip portion 16 of each clip has a narrow rectangular portion 22 at one side approximately one-half the width of the rectangular portion 16 which extends angularly upward for distance, widens to form an upper jaw portion 23 of greater width than the rectangular portion 16, and then extends downwardly to form a depending vertical jaw portion 24 in vertically opposed relation to the jaw portion 21. The lower jaw portion 20 and upwardly extending jaw portion 21 and the upper jaw portion 23 and downwardly extending jaw portion 24 form opposed upper and lower L-shaped jaw portions extending from the narrow rectangular portions 19 and 22.

The narrow rectangular portions 19 and 22 of each clip are disposed side by side in opposed angular relation and the upstanding and depending jaw portions 21 and 24 are abutted together. The diverging rectangular finger grip portions 15 and 16 are sufficiently resilient such that when pressed toward each other by the fingers of the operator, the jaw portions 21 and 24 will open and when released will resume the abutted condition.

The abutting surfaces of the jaw portions 21 and 24 may be provided with a transverse V-shaped groove 25 and a mating inverted V-shaped edge 26, respectively to facilitate gripping thin articles.

Figure 4:
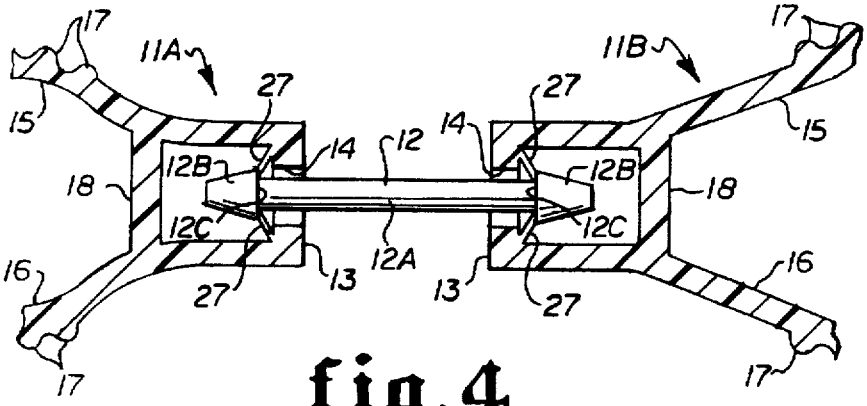
FIG. 4 is an enlarged partial side elevation of the clip device shown in cross section.
Figure 5:
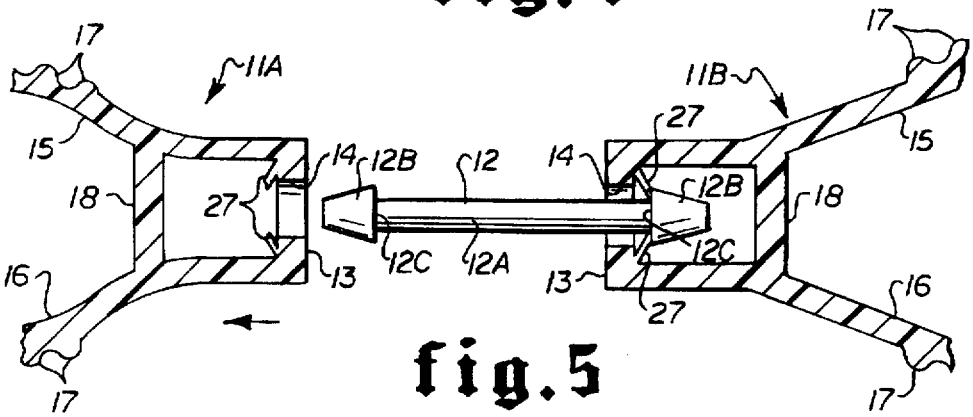
FIG. 5 is an enlarged partial side elevation of the clip device in cross section, showing the two clip members being separated after shearing of the projections.

As best seen in FIGS. 4 and 5, a plurality of short thin projections 27 surround the circular hole 14 on the inward side of each rear wall 13 in circumferentially spaced relation and converge angularly inward a short distance therefrom. The outer ends of the projections 27 form a segmented circle having a diameter smaller than the diameter of the circular hole 14.

The rod-like connecting tether 12 has a central shank portion 12A and a truncated conical head 12B at opposite ends of the shank portion. The base of each conical head 12B is larger in diameter than the diameter of the shank portion 12A to define a radial shoulder 12C therebetween. The base of each conical head 12B is also smaller in diameter than the diameter of the circular hole 14 to pass slidably therethrough but larger in diameter than the segmented circle formed by the outer ends of the projections 27.

Each clip member 11A and 11B is releasably attached to the connecting tether 12 by inserting the head 12B of the tether through the circular hole 14 and pushing it through the diverging projections 27 until it passes therethrough. As the conical head 12B passes through the outer ends of the projections 27, the projections expand outwardly and then contract radially inward around the shank portion 12A of the tether 12. Thus, when assembled, the conical head 12B is trapped between the projections 27 and the web 18. In the assembled condition, the clips 11A and 11B and the connecting tether 12 rotate relative to each other.

Under most conditions, the clips 11A and 11B are prevented from being pulled off the connecting tether 12 by the projections 27 engaging the radial shoulder 12C of the conical head 12B. However, upon an axial force of predetermined magnitude, the radial shoulder 12C of the conical head 12B will shear the projections 27 and allow the conical head to pass through the circular hole 14, as shown in FIG. 5. In a preferred embodiment, the projections are designed to shear at approximately 14 lbs. of axial force.

Figure 6:
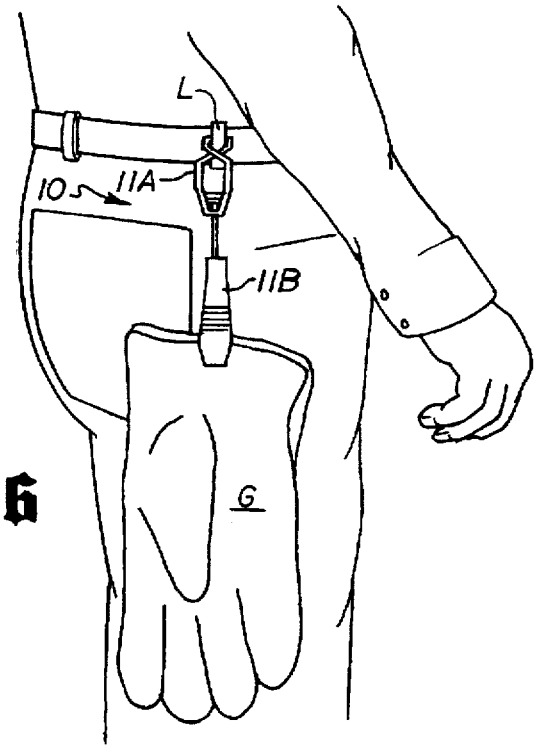
FIG. 6 is a perspective illustration showing the clip device showing one clip member attached to the belt loop of a person and the other clip member attached to a pair of gloves.

As shown in FIG. 6, one of the clips 11A is attached to an article such as a belt loop L and the other clip 11B is attached to another article such as a pair of gloves G to keep the articles together. The clips 11A and 11B are attached to the respective articles by pressing the rectangular finger grip portions 15 and 16 toward each other to open the jaw portions 21 and 24, placing the jaw portions 21 and 24 over or around the respective article, and then releasing the rectangular finger grip portions 15 and 16.

Although the clip 10 is shown connected to an article of clothing, as an example, the clip has many other utilitarian applications. The clip can be used to attach golf cloves to golf bags. The clip is also particularly suited for use underwater for scuba divers, since it has no springs or metal components. It can be used by campers to hang all kinds of articles to a tent. Many wheelchair occupants wear gloves for sanitary reasons, but if a glove is dropped, it is difficult for the wheelchair occupant to pick it up. The present clip attached to a wheelchair will reduce the possibility of dropping the gloves. The clip can be used in hospital rooms to hold tubing and wires safely out of the way. It can also be used to hold wires or electrical cables off the ground.

While this invention has been described fully and completely with special emphasis upon a preferred embodiment, it should be understood that within the scope of the appended claims the invention may be practiced otherwise than as specifically described herein.

I claim:

1. A clip for maintaining articles releasably clipped together, comprising in combination:

a first resilient clip member and a second resilient clip member each having a generally flat vertical wall at a rearward end with an aperture extending therethrough; and a resilient rod-like tether member having a central shank portion of a first diameter extending slidably through each said aperture and an enlarged diameter headed portion at opposite ends thereof disposed adjacent an inward side of each said rear wall to rotatably retain each of said clip members on said tether member in axially opposed relation and allow relative rotational movement between each of said clip members and said tether member;

each of said clip members having an upper and a lower generally rectangular longitudinal finger gripping portion diverging forwardly from said rear wall in vertically opposed relation when viewed from the side, a narrow rectangular portion extending at a forward end thereof in laterally opposed crossed relation, and an upper and a lower L-shaped jaw portion extending from said narrow rectangular portion, each of which is wider than said narrow rectangular portion;

each of said finger gripping portions being sufficiently resilient such that when pressed together by the fingers of an operator, said jaw portions will open and when released will be urged toward the abutted condition; whereby said jaw portions of said first clip member are opened and released to be engaged on or around a first article and said jaw portions of said second clip member are opened and released to be engaged on or around a second article to releasably maintain said first and second articles together.

2. The clip according to claim 1 wherein said aperture is sized and shaped to releasably retain each of said clip members on said tether member and to allow either of said clip members to become disconnected therefrom upon an axial force of predetermined magnitude.

3. A clip for maintaining articles releasably clipped together, comprising:

a first resilient clip member and a second resilient clip member each having a generally flat vertical rear wall at a rearward end with a circular hole extending therethrough, each of said clip members having a pair of intermediate longitudinal finger gripping portions extending outwardly from said rearward end in a spaced apart relation and a pair of abutting jaw portions at a forward end thereof, each of said finger gripping portions being sufficiently resilient such that when pressed together by the fingers of an operator said jaw portions will open and when released will be urged toward the abutted condition;

a plurality of short thin projections surrounding said hole on an inward side of said rear wall in circumferentially spaced relation and converging angularly inward a short distance therefrom with the outer ends thereof forming a segmented circle having a diameter smaller than the diameter of said circular hole; and a rod-like tether member having a central portion of a first diameter and an enlarged diameter headed portion at opposite ends slidably received through a respective said circular hole and retained by said projections; whereby said first and second clip members are each rotatably and releasably connected to said tether member to allow relative rotational movement between each said clip member and said tether member and said projections being capable of being sheared by said headed portion upon an axial force of predetermined magnitude to allow said clip members to become disconnected therefrom.

4. A clip for maintaining articles releasably clipped together, comprising:

a first resilient clip member and a second resilient clip member each having a generally flat vertical rear wall at a rearward end with a circular hole extending therethrough;

a plurality of short thin projections surrounding said hole on an inward side of said rear wall in circumferentially spaced relation and converging angularly inward a short distance therefrom with the outer ends thereof forming a segmented circle having a diameter smaller than the diameter of said circular hole; and a rod-like tether member having a central portion of a first diameter and an enlarged diameter headed portion at opposite ends slidably received through a respective said circular hole and retained by said projections; whereby said first and second clip members are each rotatably and releasably connected to said tether member to allow relative rotational movement between each said clip member and said tether member and said projections being capable of being sheared by said headed portion upon an axial force of predetermined magnitude to allow said clip members to become disconnected therefrom.

* * * * *